US008468021B2

(12) United States Patent
Al-Zamil et al.

(10) Patent No.: US 8,468,021 B2
(45) Date of Patent: Jun. 18, 2013

(54) SYSTEM AND METHOD FOR WRITING DIGITS IN WORDS AND PRONUNCIATION OF NUMBERS, FRACTIONS, AND UNITS

(75) Inventors: Abdullah Al-Zamil, Riyadh (SA); Fayez Al-Hargan, Riyadh (SA)

(73) Assignee: King Abdulaziz City for Science and Technology, Riyadh (SA)

( * ) Notice: Subject to any disclaimer, the term of this patent is extended or adjusted under 35 U.S.C. 154(b) by 581 days.

(21) Appl. No.: 12/837,153

(22) Filed: Jul. 15, 2010

(65) Prior Publication Data

US 2012/0016676 A1 Jan. 19, 2012

(51) Int. Cl.
*G10L 11/00* (2006.01)

(52) U.S. Cl.
USPC ..... 704/270; 715/230; 709/217; 708/204; 706/45; 704/9; 704/8; 704/260; 704/1; 434/159; 382/189; 382/114; 345/472.2

(58) Field of Classification Search
USPC .. 715/230; 709/217; 708/204; 706/45; 704/9, 704/8, 260, 1; 434/159; 382/189, 114; 345/472.3
See application file for complete search history.

(56) References Cited

U.S. PATENT DOCUMENTS 5,657,259 A * 8/1997 Davis et al. ..... 708/204
5,781,884 A * 7/1998 Pereira et al. ..... 704/260
6,654,731 B1 * 11/2003 Mahesh ..... 706/45
7,398,199 B2 * 7/2008 Gong ..... 704/8
8,244,828 B2 * 8/2012 Anderson et al. ..... 709/217
2003/0110021 A1 * 6/2003 Atkin ..... 704/1
2004/0008871 A1 * 1/2004 Smith ..... 382/114
2005/0108630 A1 * 5/2005 Wasson et al. ..... 715/513
2006/0069545 A1 * 3/2006 Wu et al. ..... 704/8
2006/0149528 A1 * 7/2006 Chang et al. ..... 704/8
2007/0016401 A1 * 1/2007 Ehsani et al. ..... 704/9
2008/0096169 A1 * 4/2008 Kim ..... 434/159
2009/0157385 A1 * 6/2009 Tian ..... 704/9
2010/0128985 A1 * 5/2010 El-Sana et al. ..... 382/189
2011/0234602 A1 * 9/2011 Wong ..... 345/472.3

OTHER PUBLICATIONS

Al-Zamil et al., "Terms of Arabic Numbers and Algorisms of Their Construction", Published Mar. 7, 2007, Islamic sciences symposium, (English and Arabic copies are included), 24 pages.

* cited by examiner

*Primary Examiner* — Michael Colucci
(74) *Attorney, Agent, or Firm* — Andrew M. Calderon; Roberts Mlotkowski Safran & Cole, P.C.

(57) ABSTRACT

Disclosed is a system and method for converting a digital number to text and for pronouncing the digital number. The system includes a filtration system for determining whether the digital number has nonnumeric symbols and for generating a filtrated number, an analyzing system for analyzing the filtrated number, a composition system configured to collect words associated with ternary units of the filtrated number, a linking system configured to link the words, and a pronouncing system for pronouncing the linked words.

20 Claims, 3 Drawing Sheets

SYSTEM AND METHOD FOR WRITING DIGITS IN WORDS AND PRONUNCIATION OF NUMBERS, FRACTIONS, AND UNITS

TECHNICAL FIELD

The present invention generally relates to converting numbers from a digital format to a text format, and more particularly, to a method and system for converting numbers from a digital format to a text format and for pronouncing the number.

BACKGROUND

The terminology of writing numbers in words is called tafgit in the Arabic language. In English, tafgit processes are relatively simple as it is achieved by simply adjoining words indicating numbers and putting a comma between them. For example, the digital number 8,746 would be expressed in written form as eight thousand, seven hundred and forty-six.

In general, the English language does not include problems relating to syntax positions. For example, in the English language, a noun does not vary according to its position as subject or object. Also, there are no morphological positions such as plural, dual, and others. However, other languages, for example, Arabic, includes both of these characteristics. Furthermore, whereas the English language provides the possibility to give names to numbers without a specific limit, other languages, such as Arabic, do not have terms for relatively high numbers. For example, in the English language, the number 1 with ten thousand zeroes on its right side may be written as ten tre-millia-trecen-do-trigin-tillion whereas the Arabic language does not have a perfect term for figures higher than 999,999.

Accordingly, there exists a need in the art to overcome the deficiencies and limitations described hereinabove.

SUMMARY

In a first aspect of the invention, a method for converting a digital number to text and for pronouncing the digital number is disclosed. The method includes receiving the digital number into a system, determining whether the number has nonnumeric symbols, converting the digital number to a filtered number, analyzing the filtered number, collecting words associated with ternary units of the filtered number, linking the words, and pronouncing the linked words.

In another aspect of the invention, a system for converting a digital number to text and for pronouncing the digital number is disclosed. The system includes a filtration system for determining whether the digital number has nonnumeric symbols and for generating a filtrated number, an analyzing system for analyzing the filtrated number, a composition system configured to collect words associated with ternary units of the filtrated number, a linking system configured to link the words, and a pronouncing system for pronouncing the linked words.

In an additional aspect of the invention, a computer program product comprising a computer usable storage medium having readable program code embodied in the medium is provided. The computer program product includes at least one component operable to convert a digital number to text and for pronouncing the digital number.

In a further aspect of the invention, a computer system for at least one of modeling and forecasting technology adoption, the system comprises a CPU, a computer readable memory and a computer readable storage media. Additionally, the system comprises first program instructions to determine whether the number has nonnumeric symbols, second program instructions to convert the digital number to a filtered number, third program instructions for analyzing the filtered number, fourth program instructions for collecting words associated with ternary units of the filtered number, fifth program instructions for linking the words, and sixth program instructions for pronouncing the linked words. The first through sixth program instructions are stored on the computer readable storage media for execution by the CPU via the computer readable memory.

In yet another aspect of the invention, A computer system for writing in words and pronouncing numbers, fractions, numbered, and units in Arabic, the system comprises: a CPU, a computer readable memory and a computer readable storage media; first program instructions to store in a database Arabic words representative of numbers in all cases and configurations; second program instructions to analyze digits, identifying the digits, remove impurities and knowing their ranks, columns, and fractions related to the numbers; third program instructions to provide word composition and collection that make up a number to form a valid Arabic sentence on a required number, in readable writing; fourth program instructions to link the number to numbered to identify the numbered and link it to a number properly, taking into account plural, double, masculine, feminine, and expression; and fifth program instructions to provide pronunciation of the numbers in words of numbers in Arabic. The first, second, third, fourth and fifth program instructions are stored on the computer readable storage media for execution by the CPU via the computer readable memory.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

Figure 1:
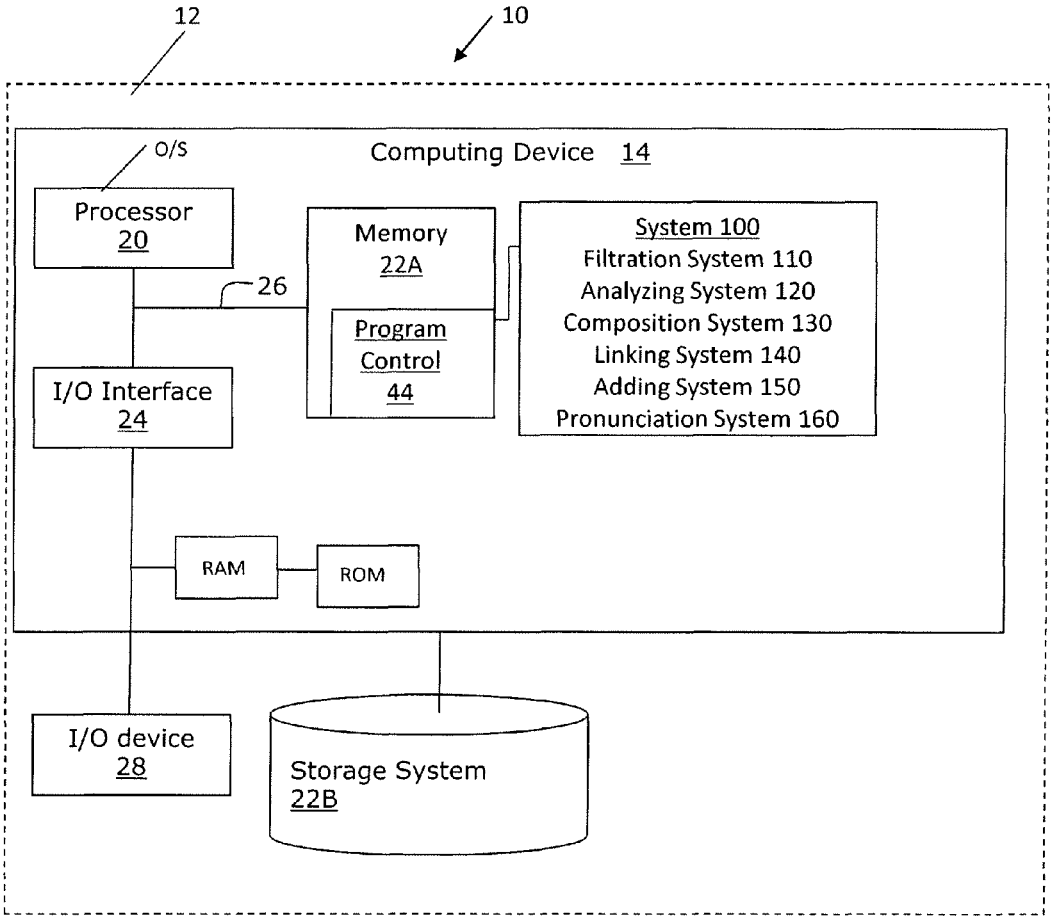
FIG. 1 an illustrative environment for implementing the steps in accordance with aspects of the invention.

The present invention generally relates to converting numbers from a digital format to a text format, and more particularly, to a method and system for writing numbers in digital format and pronouncing the numbers. Advantageously, the present invention is capable of converting Arabic numerals. In embodiments, the present invention includes an electronic Arab system for writing digits in words and the pronunciation of numbers, fractions, the numbered and units, as well as methods for the analysis of numbers and changing them from the digital format to the written format in suitable Arabic language. The present invention also contains all the formats of the words of Arabic numbers in their cases, such as the short vowel fattha, the nominative case damma, conjunction kassra, plural, double, etc., and can form suitable sentences from their stored parts in the data base of Arab numbers words.

System Environment

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

FIG. 1 shows an illustrative environment 10 for managing the processes in accordance with the invention. To this extent, the environment 10 includes a server or other computing system 12 that can perform the processes described herein. In particular, the server 12 includes a computing device 14. The computing device 14 can be resident on a network infrastructure or computing device of a third party service provider (any of which is generally represented in FIG. 1).

The computing device 14 also includes a processor 20, memory 22A, an I/O interface 24, and a bus 26. The memory 22A can include local memory employed during actual execution of program code, bulk storage, and cache memories which provide temporary storage of at least some program code in order to reduce the number of times code must be retrieved from bulk storage during execution. In addition, the computing device includes random access memory (RAM), a read-only memory (ROM), and an operating system (O/S). The memory (e.g., 22A) may store business intelligence, data mining, regression analysis and/or modeling and simulation tools for execution by the processor 20.

The computing device 14 is in communication with the external I/O device/resource 28 and the storage system 22B. For example, the I/O device 28 can comprise any device that enables an individual to interact with the computing device 14 (e.g., user interface) or any device that enables the computing device 14 to communicate with one or more other computing devices using any type of communications link. The external I/O device/resource 28 may be for example, a handheld device, PDA, handset, keyboard etc.

In general, the processor 20 executes computer program code (e.g., program control 44), which can be stored in the memory 22A and/or storage system 22B. The program code may be configured to control a series of operations associated with a conversion module 100 for converting a number from digital format to a text format. The conversion module 100 includes, for example, a filtration system 110, an analyzing system 120, a composition system 130, a linking system 140, an adding system 150, and a pronunciation system 160. These features are discussed in further detail below. In embodiments, the conversion module 100 may be a single dedicated processor or a series of dedicated processors for the functions described herein. While executing the computer program code, the processor 20 can read and/or write data to/from memory 22A, storage system 22B, and/or I/O interface 24. The program code executes the processes of the invention. The bus 26 provides a communications link between each of the components in the computing device 14.

In embodiments, the storage system 22B is a database. The database 22B, in embodiments, can store Arabic numbers in words in all their cases and configurations, the composition of these terms and numbered in Arabic without errors, and also contains audio files of the pronunciation of numbers. The present invention provides, for example:

The comprehensive inventory of all cases of numbers (e.g., valid decimal and ordinal numbers, fractions, currencies and units).

The pronunciation of numbers in proper Arabic.

Differentiating among units in the singular, plural and double (Muthanna). For example, in Arabic all of the cases have different syntax, for example, U.S. Dollar can be written as: 1 (dollar wahed), 2 (Dolaran ithnan), 3. Thalathat Dollarat), 11 (ahada ashara Dolarann).

Distinguishing between the masculine and feminine. For example, in Arabic, apple is feminine, for 3 it would be: thalatho Toffahatenn; whereas pen is masculine and for 3 it would be: thalathato Aqlamenn.

The full composition of words and sentences of numbers.

The analysis of any number whatever its length when given the names of Arabic numbers. In the Arabic language there is no purely Arabic names for numbers bigger than thousands (Alf), after which the present invention uses English names transliterated to Arabic.

In embodiments, the computing device 14 changes any number of digital format, such as (8746) to the written form (such as eight thousands, seven hundreds and forty-six), and it also pronounces the number of Arabic spoken voice. the computing device 14 is configured to to analyze the digits, whatever their length, to identify them, to remove impurities and to know their ranks, columns, and fractions as a preparation to change them to words composition system. The words composition system is configured to collect the words that make up the numbers to form a valid Arabic sentence which reflects Arab digits to be in legible writing, taking into account the expression and grammar cases according to the sound rules of Arabic. The computing device 14 links the number to numbered by identifying the numbered and link it to number properly, taking into account the plural, double, masculine, feminine, and the expression. The present invention can be implemented in the server and accessed through the Internet via HTTP protocol to send the digits to it and receive the result in the form of a text containing words of number, and audio file containing the syllable of the pronunciation of numbers.

The computing device 14 can comprise any general purpose computing article of manufacture capable of executing computer program code installed thereon (e.g., a personal computer, server, etc.). However, it is understood that the computing device 14 is only representative of various possible equivalent-computing devices that may perform the processes described herein. To this extent, in embodiments, the functionality provided by the computing device 14 can be implemented by a computing article of manufacture that includes any combination of general and/or specific purpose hardware and/or computer program code. In each embodiment, the program code and hardware can be created using standard programming and engineering techniques, respectively.

While performing the processes described herein, one or more computing devices on the server 12 can communicate with one or more other computing devices external to the server 12 using any type of communications link. The communications link can comprise any combination of wired and/or wireless links; any combination of one or more types of networks (e.g., the Internet, a wide area network, a local area network, a virtual private network, etc.); and/or utilize any combination of transmission techniques and protocols.

Example Embodiment

Figure 2:
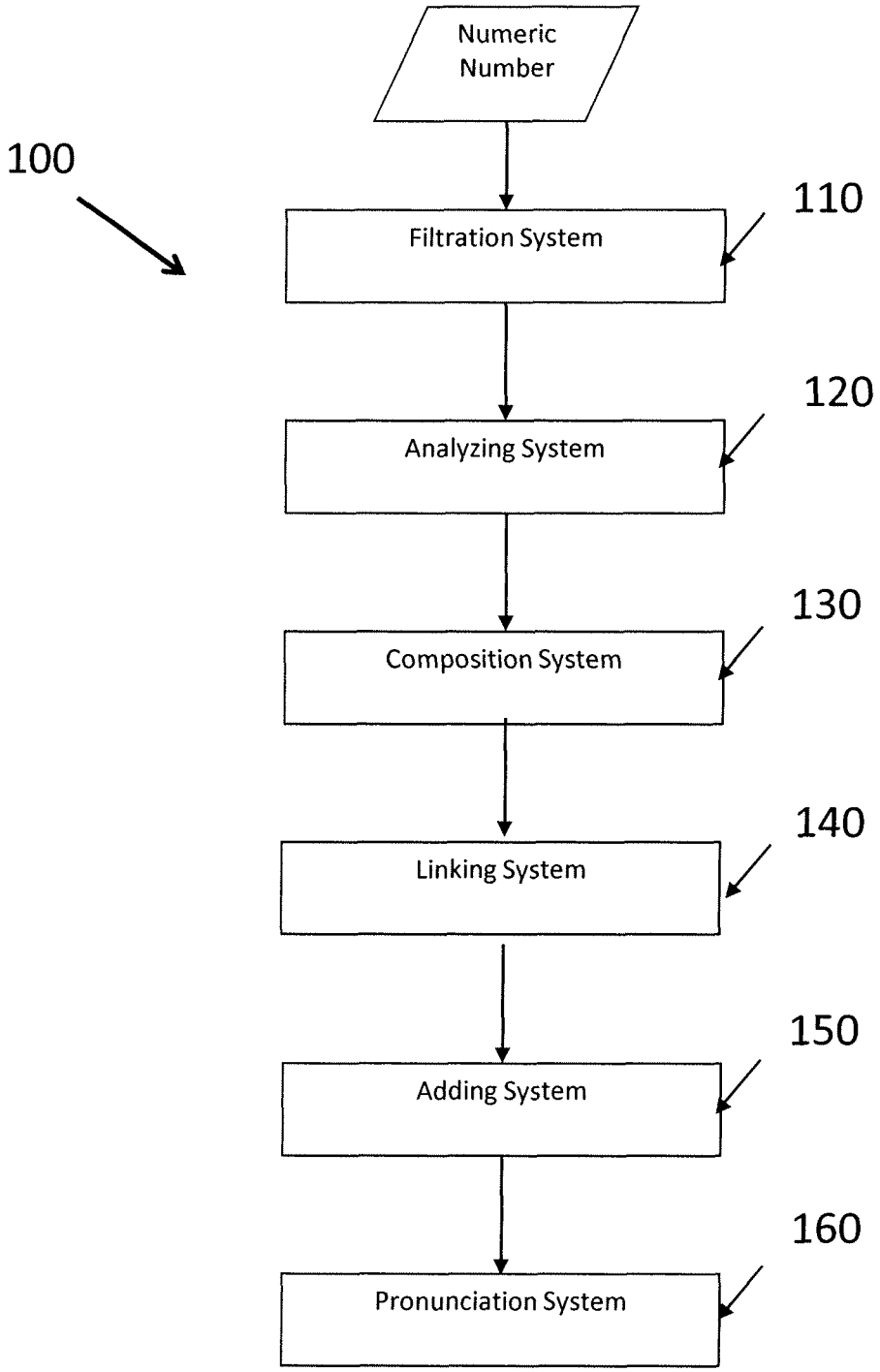
FIG. 2 is a view of a system for converting a number from a digital format to a text format and for pronouncing the word.

FIG. 2 shows an example embodiment of the present invention. The example embodiment illustrates a conversion module 100 which includes several systems or modules. For example, the conversion module 100 according to the example embodiment illustrated in FIG. 2 includes a filtration system 110, an analyzing system 120, a composition system 130, a linking system 140, an adding system 150, and a pronunciation system 160. As will be explained in greater detail, the filtration system 110 performs a filtration operation whereby a number input into the conversion module 100 is analyzed to determine whether or not nonnumeric characters were entered along with the number. The number, for example, may be entered into conversion module 100 via I/O device 28. The analyzing system 120 analyzes the number. The composition system 130 collects words that make up the number to form a valid sentence, for example, a valid sentence in Arabic. The linking system 140 identifies the numbered and links it to a number, properly, taking into account such aspects of the number such as the plural, double, masculine, feminine, and the expression. The adding system 150 adds units to the number. The pronunciation system 160 provides a system for correctly pronouncing the number, for example, in Arabic.

A number entered as digits into the conversion module 100 may be converted to text format via the operations of the filtration system 110, the analyzing system 120, the composition system 130, the linking system 140, the adding system 150, and the pronunciation system 160.

The filtration system 110 performs an initial analysis of the inputted number. The initial analysis determines whether the number includes any "blemishes." In this application, "blemishes" refer to symbols associated with the number or defects associated with the inputted number. For example, the filtration system 110 may remove blemishes associated with the number such as the symbols +, –, $, and %. The filtration system 110 may also remove defects such as spaces entered with the number as well as non value zeros which come to the at the left side of the number or on the right side of the number coming after the decimal comma. For example, a number –$1,000, 500.0500 would include five blemishes. These blemishes are the symbol "–", the symbol "$", the space between –$1,000, and 500.0500, and the two "0"s located to the right side of –$1,000,500.05. In this particular example, the two "0s" and the space between –$1,000, and 500.0500, as well as the blemishes "–" and "$" would be removed from the number prior to further analysis. For example, the number –$1,000,500.0500 would be filtered to a new number 1,000, 500.05. This new number is referred to as a filtered number, that is, a number with the blemishes removed by the filtration system.

In this example embodiment, the filtration system 110 may determine whether a symbol has meaning or not by comparing the detected symbol to a list of symbols that may be stored in a database in the filtration system. For example, if the list includes the symbols "–" and "$", then symbols "–" and "$" detected in the inputted number would be determined to have meaning.

In this example embodiment, the symbols "–" and "$" have meaning. Therefore, rather than discarding these symbols, these symbols are stored in a database for use with subsequent operations. The database, for example, may be stored in the filtration system 110, however, this example embodiment is not limited thereto. Furthermore, it should be understood that the symbols "–" and "$" are merely examples of symbols that have meaning and should not be construed to limit the example embodiment as one skilled in the art would recognize various other symbols that have meaning when expressed with numbers, for example "%."

In this example embodiment, the filtration system 110 may pass the symbols that have meaning to a database, e.g., storage system 22B. The database may, for example, be stored within the filtration system 110 or may be stored outside of the filtration system 110. Additionally, the filtration system 110 may be configured to generate suitable text for blemishes having meaning and the filtration system 110 may be configured to send that text to a collecting routine used by the adding system 150.

After the number has been analyzed by the filtration system 110 and the "blemishes" have been removed, the filtered number is analyzed by an analyzing routine executed by the analyzing system 120. In this application, a filtered number refers to a number that has undergone an initial analysis by the filtration system 110 to determine whether the input number contains blemishes. The analyzing routine analyzes not only the whole number portion of the filtered number but the decimal portion as well. For example, if the number $1,000.0500 were entered into the filtration system, the filtration system would remove the blemishes "$" and the blemishes "00" to produce the filtered number 1,000.05 and the analyzing routine executed by the analyzing system 120 would analyze the whole number portion (1,000) as well as the decimal portion (0.05). It should also be obvious from the above discussion that the blemish "$" would be stored since it has meaning while the blemish "00" would be discarded.

In further detail, the analyzing portion would divide the filtered number into two divisions. The first division is the whole number to the left of a decimal point (if present) and the second division is the number to the right of a decimal point (if present). In analyzing the whole number, the analyzing routine partitions the whole number into ternary units comprising three digits which are: digits of hundreds, digits of tens, and digits of units. For ternary units consisting of only one or two digits, one or two zeros may be added on the left side of the digit within the ternary unit. Each ternary unit would also include a specification. The specification refers to the numerical units which are taken from multiplying the number 1000 by itself. These numbers start from one thousand and proceed to a million, then a billion and so on. It should be noted that the first ternary unit does not have a specification.

Table 1 represents various examples of numbers, their ternary units, and their numerical specification. For example, the number 6,511 may be partitioned into two ternary units: the first ternary unit would include the first three numbers to the left of a decimal point (if present). Therefore, the first ternary unit would include the number [511]. The number 6,511 also includes a second ternary number which represent the next three numbers to the left of the first ternary number. Therefore, the second ternary unit would be [006] noting that two zeros were added to the second ternary number. As another example, the number 65,489,521 would include three ternary units with the first ternary unit being [521], the second ternary unit being [489], and the third ternary unit being [065] noting that one zero was added to the third ternary unit.

TABLE 1

| | Ternary Units | | | | |
|---|---|---|---|---|---|
| | Numerical Specification | | | | |
| Number | Unit 1 None | Unit 2 Thousands | Unit 3 Millions | Unit 4 Billions | Unit 5 Trillions |
| 3 | 003 | | | | |
| 15 | 015 | | | | |
| 324 | 324 | | | | |
| 6,511 | 511 | 006 | | | |
| 61,656 | 565 | 061 | | | |
| 965,485 | 485 | 965 | | | |
| 3,546,275 | 275 | 546 | 003 | | |
| 65,489,521 | 521 | 489 | 065 | | |
| 749,854,162 | 162 | 854 | 749 | | |
| 9,548,546,375 | 375 | 546 | 548 | 009 | |
| 68,475.812,744 | 744 | 812 | 475 | 068 | |
| 100,546,345,987 | 987 | 345 | 546 | 100 | |
| 6,549,346,675,482 | 482 | 675 | 346 | 549 | 006 |
| 20,647,503,654,453 | 453 | 654 | 503 | 647 | 020 |
| 301,548,976,382,645 | 645 | 382 | 976 | 548 | 301 |
| | Special Cases | | | | |
| 0 | 000 | | | | |
| 1,000 | 000 | 001 | | | |
| 1,000,254 | 25 | 000 | 001 | | |
| 3,005,782 | 782 | 005 | 003 | | |

After the numbers have been analyzed and the ternary units and specifications have been established, the composition system 130 collects words that make up the number. The words, for example, may be obtained from a database that includes formats of words. The database, for example, may include formats of words of Arabic numbers in their cases, such as the short vowel fattha, the nominative case damma, conjunction kassra, plural, double, and so on. The composition system may also put an article of adding in Arabic (Wa)

to connect the terms describing the digits. It should be noted that in the case of Arabic, generating the terms of Arabic numbers can go from the smaller term to larger term (right to left or from units to tens to hundreds), and it can go in the opposite direction from larger to smaller (from left to right or from hundreds to tens to units). It should also be noted that the second way is the most commonly used method nowadays, except between units and tens where it will more often go from smaller to bigger.

After the words have been collected by the composition system 130, the words are linked together via the linking system 140. The linking system 140 identifies the numbered and links it to a number, properly taking into account such aspects of the number such as the plural, double, masculine, feminine, and the expression, if applicable. For example, the ternary units having a value greater than zero may be linked with its numerical specification, for instance, the second unit is by thousands, the third unit by millions, the fourth unit by billions, and so on. The linking system 140 may also link all ternary units with each other by adding the addition article (wa) between each ternary unit and the one next to it. Additionally, the linking system 140 may add specification to the number in whole (if any) which is the counted item, or the thing to be counted such as the currencies, units and all counted items.

As mentioned above, the linking system identifies the numbered and links it to a number, properly taking into account such aspects of the number such as the plural, double, masculine, feminine, and the expression, if applicable. This aspect is relatively implements the above algorithms in Arabic in that the cases of masculine and feminine, singularity, duality, and plurality shall be observed as it will be enough to mention the counted item only if it is singular or dual or plural of a number is mentioned after (Riyal or Riyal wahid, but it is not possible to say wahid riyal), and also (Rialan or Riyalan ithnan but not ithnan riyal). This rule is applied for all numbers which end in its unit digit with the number one (wahid) or two (ithnan) regardless of the length of the number. This rule is also applied for the numerical for units such as one and two thousand, and one and two million, and others (alif and alfan, million and millionan, and others) but in this case no number is mentioned after them, as it is not possible to say (alfan ithnan and khamsa wa aisroun), rather, it must be said as (alfan wa khasa wa aishroun). It should also be noted there are special cases when the ternary units consists of hundreds+ the number one or two, for example, 302. In this case, one should not say (thlathuma'a wa ithnan riyal), rather, one should say (thalthuma'at Riyal wa riyalan). In the case of 301, one must not say (thlathuma'a wa wahid riyal), rather, one should say (thlathmua'at riyal wa riyal). This is also applicable for numerical specification. For example, the number (302,000) will be written (thlathuma'at alf wa alfan) and the number (301,000) should be written as (thlathuma'at alf wa alf).

In this example embodiment, the decimal number may be analyzed in the same way as analyzing the whole number as mentioned above, however, in analyzing the decimal number, any zeros added to a ternary unit would be added from the left side, rather than the right side. Similarly, generating the terms of decimal number may likewise be carried out in the same was as generating the terms of a whole number. Accordingly, a description of the treatment of the decimal portion is not disclosed for the sake of brevity.

It should be pointed out, however, there are several ways to make a specification for the decimal numbers. For example, a specification of the ternary unit parts, such as (halala part of Riyal) may be added. A sentence may be added to the decimal number it if has no specification. Additionally, the decimal numbers can be expressed in fractions if they have equivalent terms such as (nisf "half", thulth "third", and rub "quarter", as well as others (see Table 2).

TABLE No. 2

| Terms of Fractions: | | |
|---|---|---|
| Fraction | Term of Fractions | Number |
| ½ | نصف | 0.5 |
| ⅓ | ثلث | 0.333333 |
| ¼ | ربع | 0.25 |
| ⅕ | خمس | 0.2 |
| ⅙ | سدس | 0.166667 |
| ⅐ | سبع | 0.142857 |
| ⅛ | ثمن | 0.125 |
| ⅑ | تسع | 0.111111 |
| 1/10 | عشر | 0.1 |

After the number has analyzed by the filtration system 110 and the analyzing system 120, and after the composition system 130 collects words that make up the number and the linking system 140 identifies the number and links it to a number, the adding system 150 adds units to the number. For example, the adding system 150 may add a blemish that was removed by the filtration system 110 back into the number. For example, the adding system 150 may add a negative sign or a percentage sign that was removed by the filtration system 110.

Finally, after the above operations are completed, the pronunciation system 160 may provide the correct pronunciation of the number in a language, such as Arabic. The pronunciation system, for example, may utilize a database of Arabic number words in all their cases and configurations, algorithms of the composition of these terms, and numbered in Arabic without errors. Also, the database 22B may contain audio files to pronounce the numbers. The pronunciation system 160 may be configured to pronounce the numbers based on the ternary units and their specifications.

Figure 3:
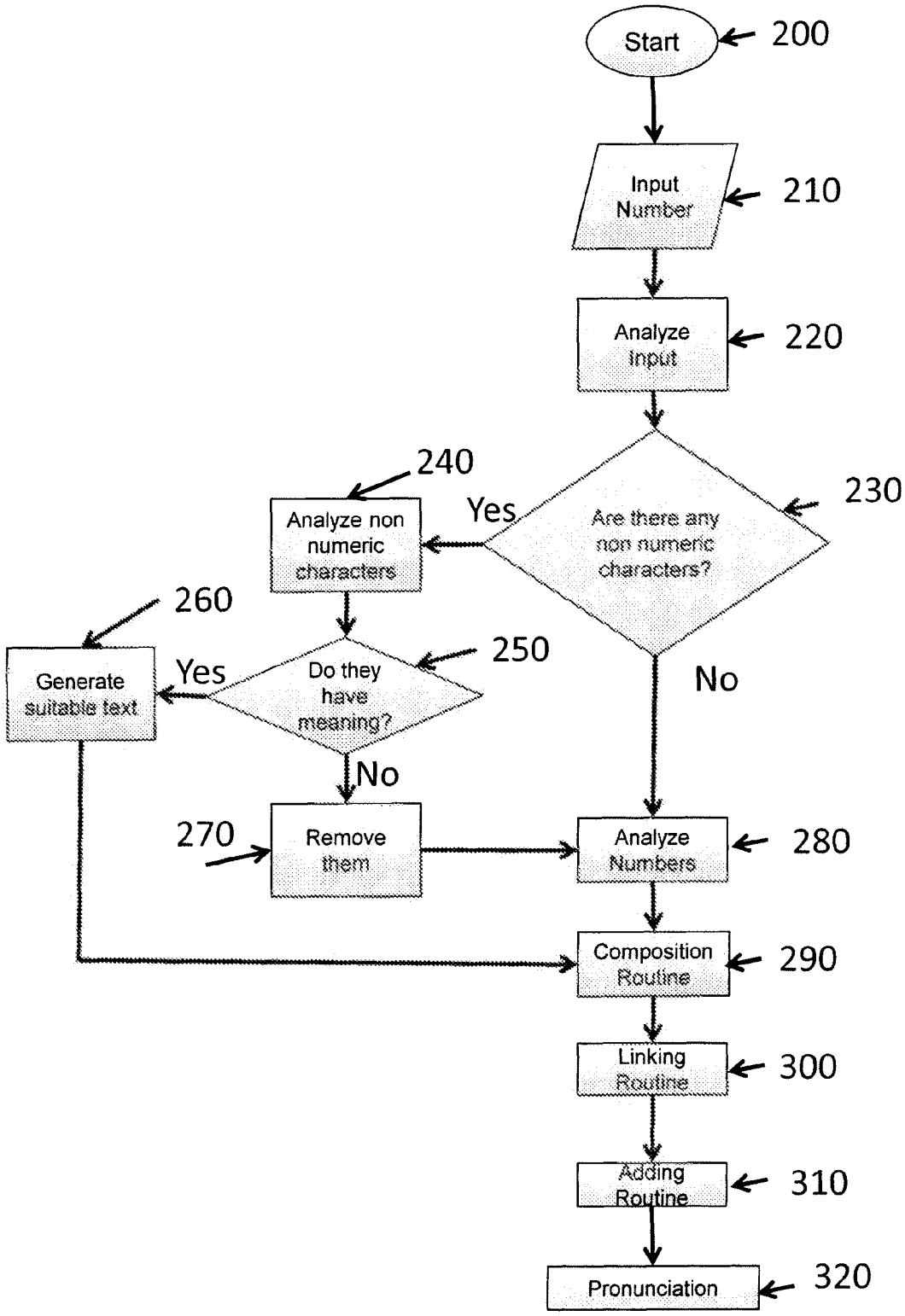
FIG. 3 shows an exemplary flow in accordance with aspects of the invention.

FIG. 3 is a flowchart illustrating the operations for converting a number entered into the conversion module 100 via the filtration system 110, the analyzing system 120, the composition system 130, the linking system 140, the adding system 150, and the pronunciation system 160.

As shown in FIG. 3, the method may begin by inputting a number 210 into the conversion module 100. As explained above, the number may be input via an I/O device 28. The number is subsequently analyzed by the filtration system in operations 220, 230, 240, 250, 260, and 270. Initially, the filtration system 110 determines 220 whether the number includes an non numeric characters ("blemishes"). In the event there are no nonnumeric characters, the number is input to the analyzing system 120 for further analysis. In the event the number includes non numeric characters, the filtration system determines whether or not the non numeric characters have meaning 250. In the event the nonnumeric characters do not have meaning, the nonnumeric characters are discarded and the number is sent to the analyzing system 120 for further analysis. In the event the nonnumeric characters do have meaning, the nonnumeric characters are stored in a database. In the alternative, the filtration system may generate suitable text and forward the text to the composition system 130 for a subsequent operation 260. After the filtration operations are completed, the filtered number is analyzed by the analyzing system 120 as illustrated in operation 280. In this operation, the numbers are partitioned into ternary units, as described above, and the specification for each of the ternary units is established. Thereafter, the composition system 130 executes a composition routine 290 which collects words that make up a number. For example, the composition routine 290 may look up data from a database that includes the formats of words. Thereafter, in operation 300, the linking system 140 identifies the numbered and links it to the number, properly taking into account such aspects of the number such as the plural, double, masculine, feminine, and the expression, if applicable. After completion of the composition routine 290, the adding routine may add the blemish that was removed by the filtration system 110. For example, if the filtration system 110 removed the blemish "%" from the number, the adding system would add the blemish back to the filtered number in operation 310. Finally, after the number has been filtered, analyzed, been processed through the composition system, the linking system, and the adding system, the number may be pronounced by the pronunciation system 160.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Furthermore, the invention can take the form of a computer program product accessible from a computer-usable or computer-readable medium providing program code for use by or in connection with a computer or any instruction execution system. The software and/or computer program product can be implemented in the environment of FIG. 1. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable storage medium include a semiconductor or solid state memory, magnetic tape, a removable computer diskette, a random access memory (RAM), a read-only memory (ROM), a rigid magnetic disk and an optical disk. Current examples of optical disks include compact disk—read only memory (CD-ROM), compact disc—read/write (CD-R/W) and DVD.

FIG. 3 depicts an exemplary flow for a process in accordance with aspects of the present invention. As can be seen in FIG. 2, the flow process may include the following processes: 1) filtration; 2) analysis; 3) composition; 4) linking; 5) adding; and 6) pronouncing. More specifically, at step 200 the system starts. At step 220, the system begins to analyze the numbers. At step 230, a determination is made as to whether there are any non-numerical characters. If so, at step 240, the system analyzes the non-numeric characters. At step 250, a determination is made as to whether the non-numerical characters have any meaning. If so, at step 260, the system generates suitable text. If not, the system removes the non-numerical values that have no meaning. At step 280, stemming from either step 270 or step 230, the system then analyzes the numbers. At step 290, stemming from either step 260 or step 280, the system provides a composition routine. At step 300, the system provides the linking routine. At step 310, the system provides an adding routine. At step 320, the system provides the pronunciation.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims, if applicable, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principals of the invention and the practical application, and to enable others of ordinary skill in the art to understand the invention for various embodiments with various modifications as are suited to the particular use contemplated. Accordingly, while the invention has been described in terms of embodiments, those of skill in the art will recognize that the invention can be practiced with modifications and in the spirit and scope of the appended claims.

What is claimed is:

1. A method for converting a digital number to text and for pronouncing the digital number in Arabic, comprising:

receiving the digital number into a system;

determining whether the number has nonnumeric symbols;

converting the digital number to a filtered number and analyzing the filtered number;

collecting words associated with ternary units of the filtered number;

linking the words; and pronouncing the linked words.

2. The method of claim 1, wherein determining whether the digital number has nonnumeric symbols includes determining whether the nonnumeric symbols have meaning.

3. The method of claim 2, further comprising:

removing, from the digital number, nonnumeric symbols that have no meaning.

4. The method of claim 3, further comprising:

adding the nonnumeric symbols that have meaning to the linked words.

5. The method of claim 2, wherein:

analyzing the filtered number includes partitioning a whole number of the filtered number into ternary units, each ternary unit having a specification;

collecting the words associated with the ternary units of the filtered number includes collecting words that form a valid sentence; and collecting the words includes collecting the words from a database which includes formats of words.

6. The method of claim 5, wherein the database includes formats of words including at least one of a short vowel fattha, a nominative case damma, conjuction kassra, plural, and double.

7. The method of claim 6, wherein the database further includes words associated with at least one of plural, double, masculine, and feminine of the digital number.

8. A system for converting a digital number to text and for pronouncing the digital number in Arabic, comprising:

a filtration system for determining whether the digital number has nonnumeric symbols and for generating a filtrated number;

an analyzing system for analyzing the filtrated number;

a composition system configured to collect words associated with ternary units of the filtrated number;

a linking system configured to link the words; and a pronouncing system configured to pronounce the linked words.

9. The system of claim 8, wherein the filtration system is configured to determine whether the digital number has nonnumeric symbols.

10. The system of claim 9, wherein the filtration system is further configured to remove, from the digital number, nonnumeric symbols that have no meaning.

11. The system of claim 10, wherein the filtration system is further configured to one of store nonnumeric symbols that have meaning and send the nonnumeric symbols that have meaning to an adding system.

12. The system of claim 9, wherein the adding system is configured to add the nonnumeric symbols that have meaning to the linked words.

13. The system of claim 9, wherein the analyzing system is configured to partition a whole number of the filtered number into ternary units, each ternary unit having a specification.

14. The system of claim 13, wherein the composition system is configured to collect words associated with the ternary units of the filtered number to form a valid sentence.

15. The system of claim 14, wherein the composition system is configured to collect the words from a database which includes formats of words.

16. The system of claim 15, wherein the database includes formats of words including at least one of a short vowel fattha, a nominative case damma, conjuction kassra, plural, and double.

17. The system of claim 16, wherein the database further includes words associated with at least one of plural, double, masculine, and feminine of the digital number.

18. The system of claim 17, further comprising displaying the digital number in the text.

19. The system of claim 18, further comprising printing the digital number in the text.

20. A computer system for writing in words and pronouncing numbers, fractions, numbered, and units in Arabic, the system comprising:

a CPU, a computer readable memory and a computer readable storage media;

first program instructions to store in a database Arabic words representative of numbers in all cases and configurations;

second program instructions to analyze digits, identifying the digits, remove impurities and knowing their ranks, columns, and fractions related to the numbers;

third program instructions to provide word composition and collection that make up a number to form a valid Arabic sentence on a required number , in readable writing;

fourth program instructions to link the number to numbered to identify the numbered and link it to a number properly, taking into account plural, double, masculine, feminine, and expression; and fifth program instructions to provide pronunciation of the numbers in words of numbers in Arabic, wherein the first, second, third, fourth and fifth program instructions are stored on the computer readable storage media for execution by the CPU via the computer readable memory.

* * * * *